US005317109A

United States Patent [19]

Aldissi

[11] Patent Number: 5,317,109

[45] Date of Patent: May 31, 1994

[54] CONDUCTIVE POLYMER CABLE ASSEMBLY

[75] Inventor: Mahmoud Aldissi, Colchester, Vt.

[73] Assignee: Champlain Cable Corporation, Colchester, Vt.

[21] Appl. No.: 901,634

[22] Filed: Jun. 19, 1992

[51] Int. Cl.[5] ..... H01R 4/20

[52] U.S. Cl. ..... 174/84 C; 29/862; 29/863; 174/82; 439/879

[58] Field of Search ..... 174/84 C, 94 R, 82; 439/874, 877, 879; 29/862, 863

[56] References Cited

U.S. PATENT DOCUMENTS

| | | | |
|---|---|---|---|
| 4,515,669 | 5/1985 | Dimond et al. | 174/84 C X |
| 4,631,808 | 12/1986 | Jones | 174/84 C |
| 4,685,761 | 8/1987 | Locati | 439/843 |
| 5,180,884 | 1/1993 | Aldissi | 174/36 |

FOREIGN PATENT DOCUMENTS

| | | | |
|---|---|---|---|
| 2498826 | 7/1982 | France | 439/879 |

*Primary Examiner*—Morris H. Nimmo
*Attorney, Agent, or Firm*—Salzman & Levy

[57] ABSTRACT

This invention features an assembly that creates a strong bond connection between a conductive polymeric element of a cable, such as a polymeric conductive core or polymeric conductive shield layer, and an electrical connector. The invention features two components: a newly styled connector, and an intermediate sleeve. The newly styled connector is made of an inner, concave, bullet-shaped recess that fits within an outer, deformable shell. The intermediate sleeve joins the polymeric element of the cable and the electrical connector. The sleeve consists of two sections. The first section has a solid, convex, bullet-shaped nose portion that fits into the concave, bullet-shaped recess located in the connector. The two bullet-shaped male and female surfaces mate with each other; they are metallic, so that they are easily solderable. The second section of the sleeve is made of a hollow tube-like portion that fits over the polymeric element; this hollow tube-like portion is deformably crimped over the polymeric element, providing a strong mechanical bond. The first section of the sleeve is solderable to the connector after the outer shell of the connector has been fitted over the sleeve and crimped onto it. The double crimp between the connector and the sleeve, and between the sleeve and the polymeric element, provides a double mechanical bond between the polymeric element, the sleeve and the connector. Such double crimping, in combination with the soldered connection, provides a very strong mechanical bond.

10 Claims, 3 Drawing Sheets

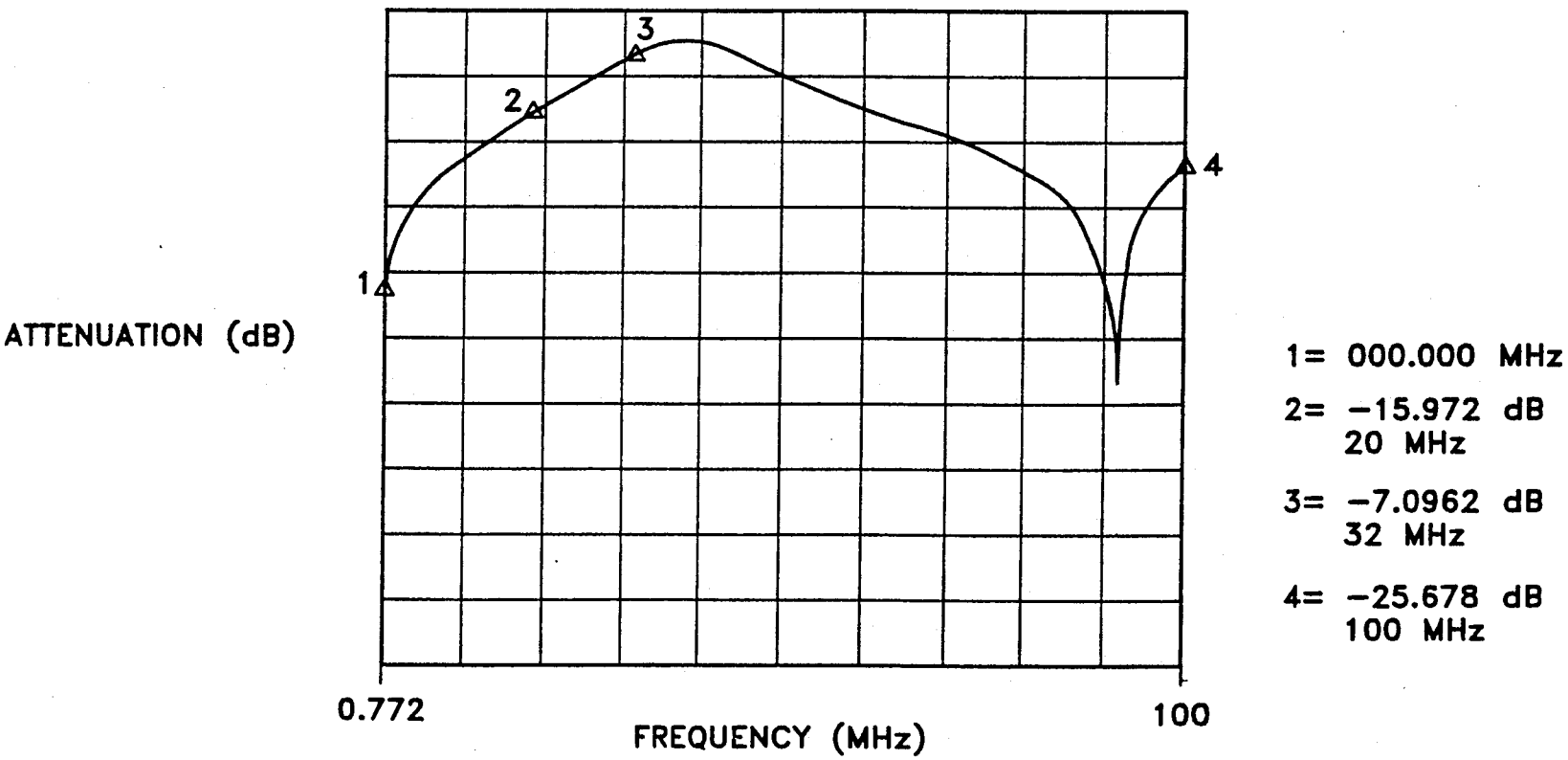
FIG−2b

CONDUCTIVE POLYMER CABLE ASSEMBLY

FIELD OF THE INVENTION

The present invention relates to apparatus for connecting conductors of cables to electrical connectors, and, more particularly, to a cable assembly which features the connection of a cable's conductive polymer core or its conductive polymer shield to an electrical connector.

BACKGROUND OF THE INVENTION

Typical cable connections are usually achieved by soldering a cable's central, conductive metal core member or its metallic, braided shield to a connector. The central, conductive metal core member and the metallic shield layer are easily soldered to a connector, the latter of which usually comprises copper metal wires.

It has recently been suggested that the central, conductive core of cables or the braiding of their shield layers be replaced by conductive polymers, or, fiber strands that are thinly coated with metal. The object of this new construction is to produce cables of thinner cross-section and lighter weight. Such conductive fibers provide cable that is more flexible and of higher tensile strength than is standard cable. This type of cable can be quite advantageous in aerospace applications.

Cable having a central, conductive, polymeric fiber core is disclosed in U.S. patent application Ser. No. 07/797,585, filed on Nov. 11, 1991 now U.S. Pat. No. 5,218,171, issued Jun. 8, 1993, for "Wire and Cable Having Conductive Fiber Core" and is assigned to a common assignee. The aforementioned patent application discloses the use of metal-coated fibers comprising Aramid. These high-tensile strength fibers are stranded in order to provide a central conductive core for the cable.

Cable having a braided or served conductive fiber shield layer is disclosed in U.S. patent application Ser. No. 07/624,952, filed on Dec. 10, 1990, now abandoned for "Non-Halogenated Insulation Composite" and is also assigned to a common assignee.

One of the problems in trying to adapt this type of cable for commercial usage is that it cannot be directly soldered to conventional electrical connectors, due to the incompatibility of the fiber's thin metal coat, which is only a few micrometers in thickness. The thinness of the metal coat does not provide enough structural metal to produce a strong solder bond. In addition, the temperature of the molten solder easily oxidizes this thin metal coat, resulting in a resistance contact that is too high for such connections.

The present invention features a cable assembly wherein the metal-coated fibers of the central, conductive core member or shield layer are connected to a newly styled connector via a crimpable intermediate sleeve. This new connector features a first portion comprising an internal, concave, bullet-shaped recess, and a second portion comprising an external, deformable shell. The intermediate sleeve comprises a bifurcated component having a first section made of a solid, convex, bullet-nose portion that fits into the concave, bullet-shaped recess of the newly styled connector, mating therewith; the second section of the sleeve consists of a hollow tube-like portion that fits over the core member or the braided shield layer and is deformably crimped thereto. The second section of the sleeve can be attached to the cable by crimping it over the core or shield layer. The bullet-nose portion of the sleeve is solderable to the connector once the connector's external, deformable shell has been fitted over the sleeve and crimped thereto. The double crimp between the connector and the sleeve, and the sleeve and the central core or shield, provides a double mechanical bond between the central core member or shield, the sleeve, and the connector. Such double crimping, in combination with the soldered bond, provides a very strong mechanical bond.

Furthermore, the connector assembly of this invention need not be discarded, should the connector need replacement or the core member require reconnection. The soldered connection to the connector can be broken by reheating, and the bullet-nose portion of the sleeve reinserted into a new connector element.

The connector assembly of this invention can be utilized with central conductive core members of any size and shield layers of any thickness.

SUMMARY OF THE INVENTION

In accordance with the present invention, there is provided a cable assembly for a cable, the central core member or the shield of which being a conductive polymer that can be connected to an electrical connector. Conductive core members comprising metal-coated polymeric fibers present several problems when solder connections are desired. Such conductive polymer cores cannot be directly soldered to electrical connectors, due to the weak bond resulting from the thin metal coatings of the polymer fibers. In addition, there is an increased core resistance resulting from oxidation of the polymer fibers' thin metal coatings during the high-temperature soldering process.

The current invention features an assembly that creates a strong bond connection to an electrical connector. The invention features two components: a newly styled connector, and an intermediate sleeve. The newly styled connector comprises an inner, concave, bullet-shaped recess disposed within an outer, deformable shell. The intermediate sleeve is disposed between the central core member or shield layer and the electrical connector. The sleeve comprises a bifurcated component having a first section comprising a solid, convex, bullet-shaped nose portion that fits into the concave, bullet-shaped recess provided in the connector. Metallic, so that they are easily solderable, the two bullet-shaped male and female surfaces mate with each other. The second section of the sleeve comprises a hollow tube-like portion that fits over the core member or shield layer and is deformably crimped thereupon, providing a strong mechanical bond. The first section of the sleeve is solderable to the connector after the outer shell thereof has been fitted over the sleeve and crimped thereto. The double crimp between the connector or the braided shield and the sleeve, and between the sleeve and the central core, provides a double mechanical bond between the central core member, the sleeve, and the connector. Such double crimping, in combination with the soldered connection, provides a very strong mechanical bond. The sleeve is tailored to the appropriate and respective sizes of the cable and electrical connector to be joined.

BRIEF DESCRIPTION OF THE DRAWINGS

A complete understanding of the present invention may be obtained by reference to the accompanying drawings, when considered in conjunction with the subsequent, detailed description, in which:

FIG. 2*b* is a graph illustrating the attenuation provided by the cable illustrated in FIG. 1, in which the conductive fiber core thereof has been replaced by metal wire.

DESCRIPTION OF THE PREFERRED EMBODIMENT

Generally speaking, the attachment of cables having conductive polymer cores to electrical connectors poses a problem, since conductive polymers are not readily solderable to metal adjuncts. The present invention features a cable assembly featuring an unusually strong mechanical bond between such a cable and an electrical connector. The cable assembly features a newly styled connector and an intermediate sleeve disposed between the connector and the conductive polymeric core or shield layer of the cable. The cable assembly features a double crimp plus a soldered connection, whereby an extremely strong mechanical bond is formed between the cable and the connector.

Figure 1:
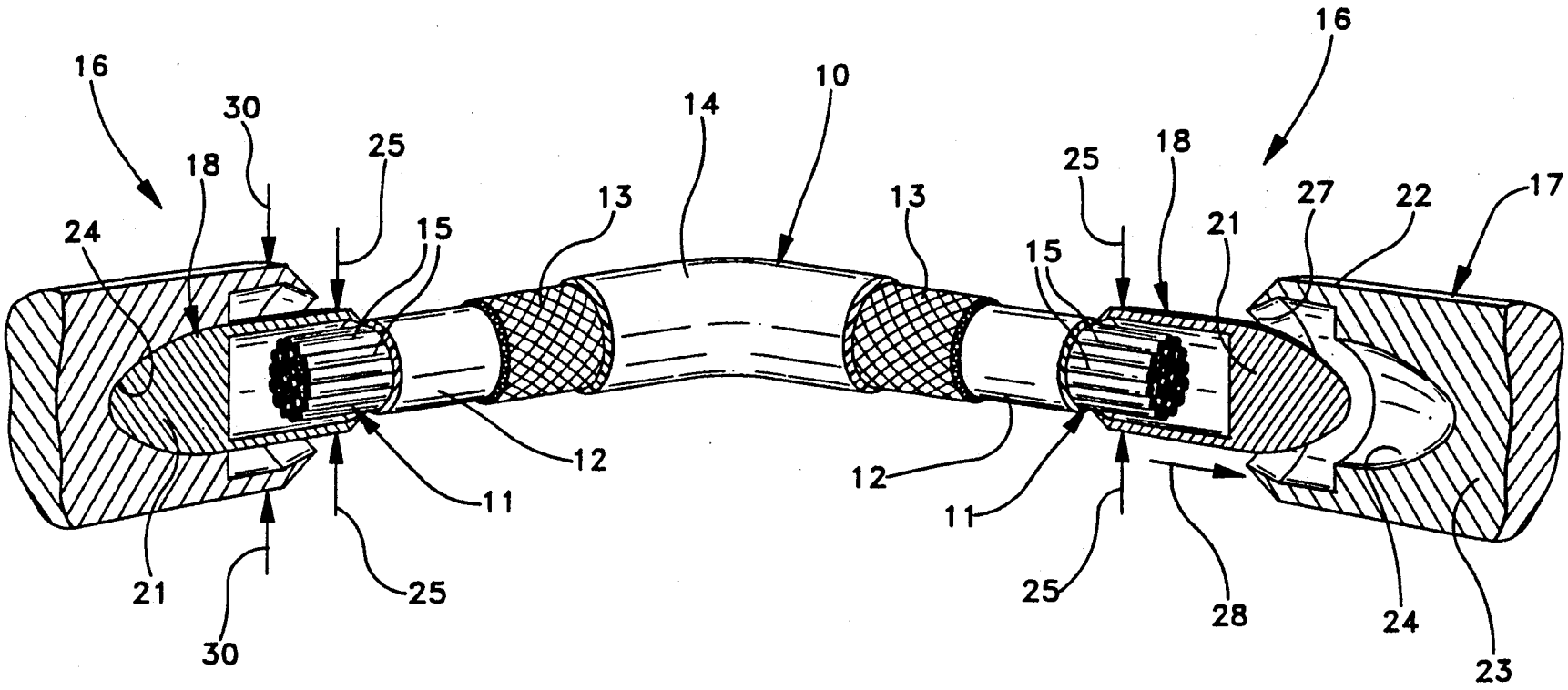
FIG. 1 is a cut-away view of a shielded cable having a conductive core comprising strands of high-tensile strength polymeric fibers. The fibers of the core are connected to an electrical connector via an intermediate sleeve. The electrical connector is a newly styled connector that is part of the new cable assembly featuring the intermediate sleeve of this invention.

Now referring to FIG. 1, a cable 10 is illustrated in a cut-away view. The cable 10 comprises a layered construction including an inner, central conductive core 11. The core 11 is overlaid with a polyvinylchloride layer of insulation 12. A shield layer 13 comprising a woven mesh of AWG 38 tin-copper wire is disposed over the insulation layer 12. The outer, jacket layer 14 consisting of Kynar is disposed over the shield layer 13, as shown.

In keeping with the purposes of this invention, the inner conductive core 11 of cable 10 comprises bundled strands 15 of metal-coated Aramid, a high-tensile strength polymeric fiber, manufactured by E. I. Du Pont de Nemours, Inc., of Delaware.

The cable assembly 16 of this invention comprises two components: (a) a newly styled electrical connector 17, and (b) an intermediate sleeve 18 disposed between the connector 17 and the inner conductive core 11. While FIG. 1 does not show the intermediate sleeve disposed atop the shield layer 13, it is to be understood that the intermediate sleeve can easily be extended to fit over the shield layer 13 and crimped thereto. The intermediate sleeve 18 comprises a deformable, hollow shell portion 20 and a forward, bullet-shaped, convex nose portion 21 comprised of a solid metal, such as copper. The newly styled electrical connector 17 comprises a deformable, hollow shell portion 22 and an inner, solid-metal section 23 having a bullet-shaped, concave recess 24 for receiving and mating with the convex, bullet-shaped nose portion 21 of the intermediate sleeve 18.

Construction of the Cable Assembly

The cable assembly 16 is constructed as follows:

(1) The hollow shell portion 20 of sleeve 18 is crimped over the bundled strands 15 of core 11, as depicted by arrows 25. The hollow shell portion 20 can also be extended (not shown) to be disposed over the shield layer 13 and crimped thereto in like fashion.

(2) Next, the bullet-shaped nose 21 of the sleeve 18 is thrust into the opening 27 of the shell portion 22 of the electrical connector 17, as shown by arrow 28 on the righthand side of the figure. The bullet-shaped nose 21 of the sleeve 18 is caused to contact and mate with the concave, bullet-shaped recess 24 of the electrical connector 17, as illustrated on the left-hand side of the FIGURE.

(3) After the respective male and female elements 21 and 24 have mated, the hollow, deformable shell portion 22 of the electrical connector 17 is crimped upon the hollow shell portion 20 of sleeve 18, as shown by arrows 30 illustrated on the left-hand side of the FIGURE.

(4) In the final step of the cable assembly construction, the two respective, mating elements 21 and 24 are soldered together.

The resulting cable assembly construction described above provides a cable/connector construction which is extremely strong by virtue of the double crimp and soldered connections. This construction avoids the harmful oxidation of the metal coating of fiber strands 15. Cable components 17 and 18 are not limited to given sizes; these components can be tailored to accommodate a cable of any desired size.

It should be evident to those skilled in the art that the above construction can accommodate repeated repairs and/or modifications to the cable 10 anywhere along its length.

Figure 2A:
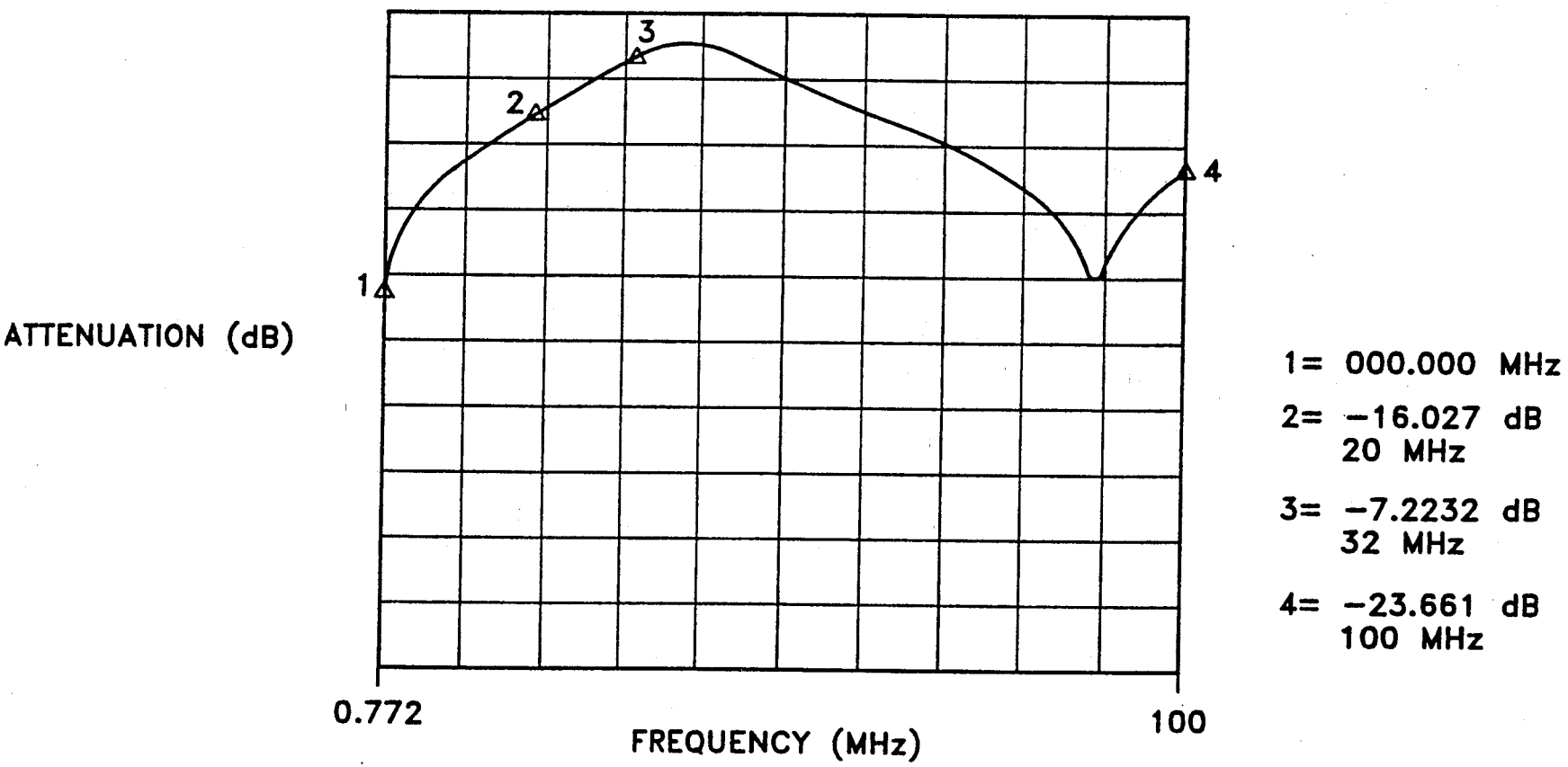
FIG. 2*a* is a graph illustrating the attenuation provided by the cable illustrated in FIG. 1.

Referring to FIG. 2*a*, a graph is illustrated of the operational characteristics for a cable 10 having the construction of this invention, as depicted above in FIG. 1. The graph shows the attenuation characteristics of cable 10, with respect to frequency. The operational characteristics of this cable (FIG. 2*a*) are compared with the operational characteristics of a modified cable, as illustrated in the graph shown in FIG. 2*b*. The modified cable of FIG. 2*b* comprises a cable 10 which has an inner conductive core 11 comprising strands of AWG 38 tin-copper wire, instead of the metal-coated Aramid fibers, as depicted in FIG. 1. All other parts of the modified cable are identical to the original cable 10 construction. The core 11 of the modified cable is soldered in traditional fashion to the electrical connector 17. The comparison of the two graphs of respective FIGS. 2*a* and 2*b* indicates that the invention provides a connection for the polymeric core 11 of cable 10 of FIG. 1 which is functionally equivalent to standard cable connections. However, it should be noted that the polymeric core 11 of cable 10 provides an improvement in the higher frequency ranges for which it was designed.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the present invention, what is desired to be protected by Letters Patent is presented in the subsequently appended claims.

What is claimed is:

1. A cable connection construction for a cable having a conductive polymeric element such as a conductive polymeric core or shield layer, comprising;

a first component comprising a first deformable portion for attachment to a conductive polymeric element of a cable such as a core or shield layer by means of crimping said first deformable portion about said conductive polymeric core or shield layer, said first component additionally having a male element contiguously joined to said first deformable portion for mating with a female recess disposed in an electrical connector; and a second component comprising an electrical connector having a second deformable portion and a solid portion defining a female recess for receipt of, and mating with, said male element of said first component, said second deformable portion of said second component being securable about said first deformable portion of said first component by crimping said second deformable portion about said first deformable portion, whereby said electrical connector is attached to the conductive polymeric element by means of a double crimp that provides a connection of improved mechanical strength.

2. The cable connection construction in accordance with claim 1, further comprising a solder connection between said male element of said first component and said female recess defined by said solid portion of said second component.

3. The cable connection construction in accordance with claim 1, wherein said male element and said female recess comprise bullet-shaped mating surfaces.

4. The cable connection construction in accordance with claim 1, wherein said first component defines an intermediate sleeve disposed between said electrical connector and said conductive polymeric element.

5. A cable connection construction for a cable having a conductive polymeric element such as a polymeric core or polymeric shield layer, said cable construction including an electrical connector and an intermediate sleeve that fits within and attaches to said electrical connector, and attaches to said conductive polymeric element of said cable, said cable connection comprising;

an electrical connector having a second deformable portion and a solid portion defining a female recess for receipt of, and mating with, a male element of an intermediate sleeve, said second deformable portion of said electrical connector being securable about said deformable portion of said intermediate sleeve by means of a crimping securement of said second deformable portion about a first deformable portion of said intermediate sleeve; and an intermediate sleeve comprising a first deformable portion for attachment to a conductive polymeric element of a cable by means of a crimping securement of said first deformable portion about said conductive polymeric element, said intermediate sleeve additionally having a male element contiguously joined to said first deformable portion for mating with said female recess disposed in an electrical connector; whereby said electrical connector is attached to the conductive polymeric element via said intermediate sleeve by means of a double crimp that provides a connection of improved mechanical strength.

6. The cable connection construction in accordance with claim 5, further comprising a solder connection between said male element of said intermediate sleeve and said female recess defined by said solid portion of said electrical connector.

7. The cable connection construction in accordance with claim 5, wherein said male element and said female recess comprise bullet-shaped mating surfaces.

8. A cable connection construction for a cable having a conductive polymeric element such as a polymeric core or polymeric shield layer, said cable construction including an electrical connector and an intermediate sleeve that fits within and attaches to said electrical connector, and attaches to said conductive polymeric element of said cable, said cable connection comprising;

an electrical connector having a second deformable portion and a solid portion contiguously joined thereto, defining a female recess for receipt of, and mating with, a male element of an intermediate sleeve, said second deformable portion of said electrical connector being securable about said deformable portion of said intermediate sleeve by means of a crimping securement of said second deformable portion about a first deformable portion of said intermediate sleeve;

an intermediate sleeve comprising a first deformable portion for attachment to a conductive polymeric element of a cable by means of a crimping securement of said first deformable portion about said conductive polymeric element, said intermediate sleeve additionally having a male element contiguously joined to said first deformable portion for mating with said female recess disposed in an electrical connector; whereby said electrical connector is attached to the conductive polymeric element via said intermediate sleeve by means of a double crimp that provides a connection of improved mechanical strength; and means defining a solder connection between said male element of said intermediate sleeve and said female recess defined by said solid portion of said electrical connector.

9. A method of attaching an electrical connector to a conductive polymeric element of a cable, such as a polymeric conductive core or polymeric conductive shield layer, comprising the steps of;

a) attaching an intermediate sleeve to a conductive polymeric element of a cable and securing said intermediate sleeve to said conductive polymeric element by means of crimping said intermediate sleeve about said conductive polymeric element; and b) attaching an electrical connector having a crimpable portion and an adjacent female mating surface to said intermediate sleeve and securing said electrical connector to said intermediate sleeve by means of crimping said electrical connector about said intermediate sleeve, said intermediate sleeve mating with said electrical connector via respective male and female mating surfaces disposed thereupon.

10. The method of claim 9, further comprising the step of;

c) forming a solder connection between said male and female mating surfaces.

* * * * *